US009915910B2

(12) United States Patent
Hagimoto et al.

(10) Patent No.: US 9,915,910 B2
(45) Date of Patent: Mar. 13, 2018

(54) CLEANING DEVICE AND IMAGE FORMING APPARATUS

(71) Applicant: Konica Minolta, Inc., Tokyo (JP)

(72) Inventors: Noritoshi Hagimoto, Toyohashi (JP); Eri Yoshida, Aichi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/371,836

(22) Filed: Dec. 7, 2016

(65) Prior Publication Data

US 2017/0168448 A1 Jun. 15, 2017

(30) Foreign Application Priority Data

Dec. 9, 2015 (JP) ..... 2015-239963

(51) Int. Cl.
*G03G 21/00* (2006.01)

(52) U.S. Cl.
CPC ..... *G03G 21/0017* (2013.01); *G03G 21/0011* (2013.01)

(58) Field of Classification Search
CPC ..... G03G 21/0011; G03G 21/0017; G03G 21/0029
See application file for complete search history.

(56) References Cited

U.S. PATENT DOCUMENTS 7,123,872 B2 * 10/2006 Shakuto ..... G03G 21/0029 399/350
2006/0291928 A1 * 12/2006 Lee ..... G03G 21/0029 399/350
2010/0150628 A1 * 6/2010 Miki ..... B29C 41/003 399/350
2013/0071164 A1 3/2013 Sunahara

FOREIGN PATENT DOCUMENTS

JP H05-224542 A 9/1993
JP 2002-268487 A 9/2002
JP 2006-267299 A 10/2006
JP 2008-111972 A 5/2008
JP 2013-064768 A 4/2013

OTHER PUBLICATIONS

Office Action (Notice of Reasons for Rejection) dated Dec. 12, 2017, by the Japanese Patent Office in corresponding Japanese Patent Application No. 2015-239963 and English Translation of the Office Action. (9 pages).

* cited by examiner

*Primary Examiner* — Gregory H Curran
(74) *Attorney, Agent, or Firm* — Buchanan Ingersoll & Rooney PC

(57) ABSTRACT

A cleaning device includes a cleaning member configured to move in the opposite direction from a moving direction of an image carrier and come into contact with a surface of the image carrier to remove residual matter from the surface of the image carrier, wherein the cleaning member includes a (Continued)

supporting member formed with a metallic plate spring and a contact member formed with an elastic material and bonded to an end of the supporting member, an edge portion at an end of the contact member being brought into contact with the surface of the image carrier, the end of the contact member protrudes from the end of the supporting member, and the end of the supporting member is located on an upstream side of a normal line of the image carrier at the contact position of the edge portion in the moving direction of the image carrier.

4 Claims, 9 Drawing Sheets

CLEANING DEVICE AND IMAGE FORMING APPARATUS

The entire disclosure of Japanese Patent Application No. 2015-239963 filed on Dec. 9, 2015 including description, claims, drawings, and abstract are incorporated herein by reference in its entirety.

BACKGROUND OF THE INVENTION

Field of the Invention

The present invention relates to a cleaning device that removes residual matter such as toner on the surface of an image carrier with a cleaning member, and an image forming apparatus using such a cleaning device. Particularly, the cleaning device characteristically uses a cleaning member that includes a supporting member formed with a metallic plate spring and a contact member formed with an elastic material, the contact member being bonded to the supporting member with an adhesive. The contact member of this cleaning member is moved in the opposite direction of the moving direction of the image carrier, and is brought into contact with the surface of the image carrier, to remove residual matter on the surface of the image carrier. In this process, the contact member can be stably brought into contact with the surface of the image carrier by the supporting member with a sufficient contact pressure. Furthermore, the amount of residual matter staying on the end surface of the contact member brought into contact with the surface of the image carrier is prevented from varying in the longitudinal direction of the contact member, and the residual matter on the surface of the image carrier can be appropriately removed over a long period of time.

Description of the Related Art

In a conventional image forming apparatus, such as a copying machine, a printer, a facsimile machine, or a multifunctional machine having the functions of a copying machine, a printer, and a facsimile machine, a toner image is transferred from an image carrier moving while holding the toner image on the surface thereof, and residual matter such as toner remaining on the surface of the image carrier is then removed from the surface of the image carrier by a cleaning device. For example, after a toner image formed on a photosensitive member is transferred onto an intermediate transfer member such as an intermediate transfer belt or a recording sheet, residual matter such as toner remaining on the surface of the photosensitive member is removed by a cleaning device. Alternatively, after a toner image is transferred onto an intermediate transfer member, residual matter such toner remaining on the surface of the intermediate transfer member is removed by a cleaning device.

As such a cleaning device, a cleaning device 2 shown in FIG. 1A is widely used. In this cleaning device 2, the end of a cleaning member 3 formed with a plate-like cleaning blade made of an elastic material such as urethane is moved in the opposite direction from the moving direction of an image carrier 1 and is brought into contact with the surface of the image carrier 1 after a toner image is transferred, and residual matter t such as toner remaining on the surface of the image carrier 1 is removed from the surface of the image carrier 1 by the cleaning member 3.

In such a case where the end of the plate-like cleaning member 3 made of an elastic material is pressed against the surface of the image carrier 1, and residual matter t such as toner remaining on the surface of the image carrier 1 is removed, a certain amount of residual matter t is caught between the end of the cleaning member 3 and the image carrier 1, and the caught residual matter t functions as a lubricant to reduce the frictional resistance between the end of the cleaning member 3 and the image carrier 1.

However, if low-coverage image formation is continued for a long time, the amount of residual matter t caught between the end of the cleaning member 3 and the image carrier 1 decreases, or an environmental condition such as temperature or humidity changes. As a result, the frictional resistance between the end of the cleaning member 3 and the image carrier 1 increases. Due to the frictional force between the image carrier 1 and the end of the cleaning member 3, the end of the cleaning member 3 is pulled by the image carrier 1. In that case, the end of the cleaning member 3 is bent in the reverse direction, and ends up having a curled-up portion, as shown in FIG. 1B.

Consequently, the residual matter t such as toner remaining on the surface of the image carrier 1 cannot be appropriately removed by the cleaning member 3, or a load is applied to the image carrier 1, resulting in scratches on the surface of the image carrier 1 or incorrect movement of the image carrier 1.

JP 2002-268487 A discloses a cleaning member in which a contact member formed with an elastic material is bonded to the end of a supporting member with an adhesive in such a manner that the contact member protrudes from the end of the supporting member formed with a metallic plate spring. JP 2008-111972 A discloses a cleaning member in which a contact member formed with an elastic material is bonded to a portion located slightly away from the end of a supporting member with an adhesive so that the end of the supporting member formed with a metallic plate spring protrudes from the contact member, and the contact member of the cleaning member is moved in the opposite direction from the moving direction of the image carrier and is brought into contact with the surface of the image carrier, to remove residual matter such as toner remaining on the surface of the image carrier.

In a case where the cleaning member disclosed in JP 2002-268487 A is used, a contact member 3*b* formed with an elastic material is bonded to the end of a supporting member 3*a* with an adhesive 3*c* in such a manner that the contact member 3*b* protrudes from the end of the supporting member 3*a* formed with a metallic plate spring, as shown in FIG. 2. If the protruding portion of the contact member 3*b* protruding from the end of the supporting member 3*a* is too long in this process, the protruding portion is deformed over time, and it becomes difficult to bring the contact member 3*b* into contact with the surface of the image carrier 1 via the supporting member 3*a*. As a result, residual matter t such as toner remaining on the surface of the image carrier 1 cannot be appropriately removed. To prevent such a decrease in pressure, the pressure for bringing the contact member 3*b* into contact with the surface of the image carrier 1 is increased. In that case, due to the frictional force between the image carrier 1 and the end of the contact member 3*b*, the end of the contact member 3*b* is pulled by the moving image carrier 1 and ends up having a curled-up portion, as in the above described case with the plate-like cleaning member formed with an elastic material. As a result, the residual matter t such as toner remaining on the surface of the image carrier 1 cannot be appropriately removed, the surface of the image carrier 1 is scratched, or the image carrier 1 moves in an incorrect manner.

In a case where the cleaning member disclosed in JP 2008-111972 A is used, a contact member 3*b* formed with an elastic material is bonded to a portion located slightly away from the end of a supporting member 3*a* with an adhesive 3*c* so that the end of the supporting member 3*a* formed with a metallic plate spring protrudes from the contact member 3*b*, as shown in FIG. 3A. If the amount of the adhesive 3*c* for bonding the contact member 3*b* to the supporting member 3*a* is too large in this process, the adhesive 3*c* strays onto the end surface of the end of the contact member 3*b*, and the amount of the stray adhesive 3*c* varies in the longitudinal direction of the contact member 3*b*, as shown in FIG. 3B. Consequently, the amount of residual matter t caught between the end of the contact member 3*b* and the image carrier 1 varies in the longitudinal direction of the contact member 3*b*. As a result, the frictional resistance between the end of the contact member 3*b* and the image carrier 1 varies in the longitudinal direction of the contact member 3*b*. Due to this variation, the cleaning becomes inadequate, or the abrasion of the surface of the image carrier 1 becomes uneven, leading to density unevenness in a formed image, for example. Further, if the pressure for bringing the contact member 3*b* into contact with the surface of the image carrier 1 is increased in this case, the end of the contact member 3*b* is pulled by the moving image carrier 1 and ends up having a curled-up portion due to the frictional force between the image carrier 1 and the end of the contact member 3*b*, as in the above described case. As a result, the end of the supporting member 3*a* formed with a metallic plate spring collides with the surface of the image carrier 1, and the surface of the image carrier 1 is scratched, or the driving of the image carrier 1 is stopped, for example.

In a case where a contact member 3*b* formed with an elastic material is bonded to a supporting member 3*a* with an adhesive 3*c* in such a manner that the end of the supporting member 3*a* formed with a metallic plate spring is located in the same position as the end of the contact member 3*b*, if the amount of the adhesive 3*c* for bonding the contact member 3*b* to the supporting member 3*a* is too large, the adhesive 3*c* strays onto the end surface of the end of the contact member 3*b*, as shown in FIG. 4A, and the same problems as those in the case illustrated in FIGS. 3A and 3B are caused. If the amount of the adhesive 3*c* is reduced so that the adhesive 3*c* does not stray onto the end surface of the end of the contact member 3*b*, as shown in FIG. 4B, the end of the contact member 3*b* is pulled by the moving image carrier 1. As a result, the end of the contact member 3*b* not firmly bonded to the supporting member 3*a* is curled up, and the contact member 3*b* is detached from the supporting member 3*a*.

SUMMARY OF THE INVENTION

An object of the present invention is to solve the above described problems in a cleaning device that removes residual matter on the surface of an image carrier by using a cleaning member that includes a supporting member formed with a metallic plate spring and a contact member formed with an elastic material. The contact member of the cleaning member is bonded to the end of the supporting member of the cleaning member, and the contact member is moved in the opposite direction from the moving direction of the image carrier and is brought into contact with the surface of the image carrier to remove the residual matter on the surface of the image carrier.

That is, the object of the present invention is to bring the contact member formed with an elastic material into contact with the surface of the image carrier stably with a sufficient contact pressure by using the supporting member formed with a metallic plate spring in the above described cleaning device. Furthermore, the amount of residual matter staying on the end surface of the contact member brought into contact with the surface of the image carrier is to be prevented from varying in the longitudinal direction of the contact member, so that residual matter on the surface of the image carrier can be appropriately removed over a long period of time.

To achieve the abovementioned object, according to an aspect, a cleaning device reflecting one aspect of the present invention comprises a cleaning member configured to move in the opposite direction from a moving direction of an image carrier and come into contact with a surface of the image carrier to remove residual matter from the surface of the image carrier, wherein the cleaning member includes a supporting member formed with a metallic plate spring and a contact member formed with an elastic material, the contact member being bonded to an end of the supporting member with an adhesive, an edge portion at an end of the contact member being brought into contact with the surface of the image carrier, the end of the contact member protrudes from the end of the supporting member, and the end of the supporting member is located on an upstream side of a normal line of the image carrier at the contact position of the edge portion in the moving direction of the image carrier.

In a case where the contact member is bonded to the end of the supporting member with the adhesive so that the end of the contact member protrudes from the end of the supporting member as described above, the adhesive is prevented from straying onto the end surface of the end of the contact member even if the amount of the adhesive is too large. Furthermore, in a case where the edge portion at the end of the contact member is brought into contact with the surface of an image carrier as described above, the end of the supporting member is located on the upstream side of the normal line of the image carrier at the contact position of the edge portion in the moving direction of the image carrier. In this manner, the edge portion of the contact member is appropriately pressed against the surface of the image carrier by the supporting member, and the end of the contact member is prevented from being pulled by the moving image carrier and ending up having a curled-up portion.

In a case where the edge portion at the end of the contact member of a cleaning device according to an embodiment of the present invention is brought into contact with the surface of an image carrier, the end of the supporting member is located on the upstream side of the normal line of the image carrier at the contact position of the edge portion in the moving direction of the image carrier. In this case, the angle of the edge portion of the contact member to be brought into contact with the surface of the image carrier is not particularly specified. However, the angle of the edge portion of the contact member is preferably set at a greater angle than 90 degrees so that the end of the supporting member is appropriately located on the upstream side of the normal line of the image carrier in the moving direction of the image carrier.

In a cleaning device according to an embodiment of the present invention, the protruding portion of the end of the contact member protruding from the end of the supporting member preferably has a length of 0.4 mm or greater. In a case where the length of the protruding portion of the end of the contact member protruding from the end of the supporting member is adjusted to 0.4 mm or greater, the condition expressed as $[\tan\theta+\tan(\alpha-90°)]\times t\geq 0.4$ is preferably satisfied, where $\alpha$ (°) represents the angle of the edge portion of the contact member, $\theta$ (°) represents the contact angle between the tangent line of the image carrier at the contact position of the edge portion of the contact member and the opposed surface on the downstream side of the contact member in the direction from the edge portion toward the downstream side in the moving direction of the image carrier, and t (mm) represents the thickness of the contact member.

The contact angle θ (°) is preferably in the range of 10 to 20 degrees so that the end of the contact member is appropriately made to protrude from the end of the supporting member, and the end of the supporting member is located on the upstream side of the normal line of the image carrier at the contact position of the edge portion of the contact member in the moving direction of the image carrier.

To achieve the abovementioned object, according to an aspect, an image forming apparatus reflecting one aspect of the present invention comprises the cleaning device configured to remove residual matter on a surface of an image carrier.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 1A is a side cross-sectional diagram for explaining a situation where the end of the cleaning member is moved in the opposite direction from the moving direction of the image carrier and is pressed against the surface of the image carrier; and FIG. 1B is a side cross-sectional diagram for explaining a situation where the end of the cleaning member is bent in the reverse direction, and ends up having a curled-up portion;

FIG. 3A is a side cross-sectional diagram for explaining the situation; and FIG. 3B is a cross-sectional diagram of the front side for explaining the situation;

FIG. 4A is a side cross-sectional diagram for explaining a situation where the amount of the adhesive is large, and the adhesive strays onto the end surface of the end of the contact member; and FIG. 4B is a side cross-sectional diagram for explaining a situation where the amount of the adhesive is small, and the end of the contact member is pulled by the image carrier and ends up having a curled-up portion;

FIG. 6A is a side cross-sectional diagram for explaining a situation where residual matter remaining on the surface of a photosensitive member is removed by a cleaning device; and FIG. 6B is a side cross-sectional diagram for explaining a situation where residual matter remaining on the surface of an intermediate transfer belt is removed by a cleaning device;

FIG. 7A is a partially enlarged diagram for explaining a case where the angle of the edge portion of the contact member is set at 90 degrees; and FIG. 7B is a partially enlarged diagram for explaining a case where the angle of the edge portion of the contact member is set at a greater angle than 90 degrees;

FIG. 8A is a partially enlarged diagram for explaining a situation where a contact member with parallelogram side surfaces each having an obtuse angle as the angle of the edge portion is used; and FIG. 8B is a partially enlarged diagram for explaining a situation where a contact member with pentagonal side surfaces each having an obtuse angle as the angle of the edge portion is used;

DESCRIPTION OF THE PREFERRED EMBODIMENTS

Hereinafter, a cleaning device and an image forming apparatus according to an embodiment of the present invention will be described specifically with reference to the drawings. However, the scope of the invention is not limited to the illustrated examples. Cleaning devices and image forming apparatuses according to embodiments of the present invention are not limited to those according to the embodiment described below, and modifications may be made to them as appropriate without departing from the scope of the invention.

Figure 5:
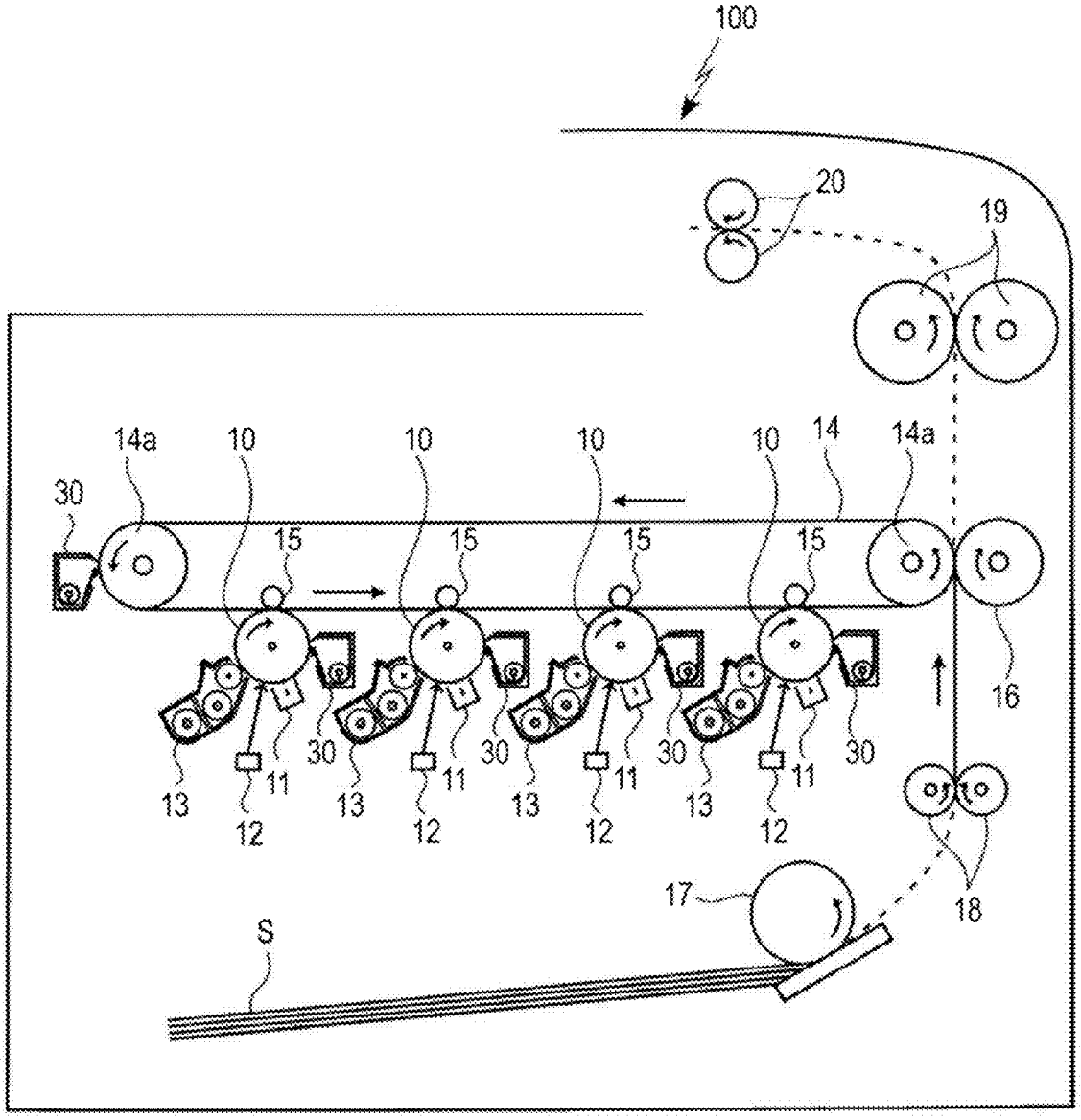
FIG. 5 is a schematic cross-sectional diagram for explaining a usage state of an image forming apparatus that includes cleaning devices according to an embodiment of the present invention.

In an image forming apparatus 100 according to this embodiment, four developing devices 13 containing developers are provided for four photosensitive members (image carriers) 10 on which toner images are to be formed, as shown in FIG. 5. In the respective developing devices 13, the colors of the toners in the respective developers differ from one another, and toners in black, yellow, magenta, and cyan are used.

In this image forming apparatus 100, the respective photosensitive members 10 are rotated, and the surfaces of the respective photosensitive members 10 are electrically charged by charging devices 11. The respective photosensitive members 10 electrically charged in this manner are exposed by latent image forming devices 12 in accordance with image formation information, so that electrostatic latent images are formed on the surfaces of the respective photosensitive members 10.

Toners in predetermined colors are then supplied from the developing devices 13 to the electrostatic latent images formed in the above manner on the respective photosensitive members 10, and development is conducted, so that toner images in the respective colors are formed on the surfaces of the respective photosensitive members 10.

The toner images in the respective colors formed in the above manner on the respective photosensitive members 10 are then sequentially transferred onto the surface of an intermediate transfer belt (an image carrier) 14 in the primary transfer process by primary transfer rollers 15 located to face the respective photosensitive members 10, so that a full-color toner image is formed on the surface of this intermediate transfer belt 14. The intermediate transfer belt 14 is an endless belt that is stretched around rotating rollers 14*a* and is driven to rotate.

Residual matter t such as the toners that have not been transferred onto the intermediate transfer belt 14 and remain on the surfaces of the respective photosensitive members 10 is removed from the surfaces of the respective photosensitive members 10 by first cleaning devices 30.

The full-color toner image formed in the above manner on the surface of the intermediate transfer belt 14 is then guided by the intermediate transfer belt 14 to a position to face a secondary transfer roller 16.

Meanwhile, a recording sheet S stored in a lower portion of the image forming apparatus 100 is sent to timing rollers 18 by a sheet feed roller 17. The timing rollers 18 guide the recording sheet S to the portion between the intermediate transfer belt 14 and the secondary transfer roller 16, so that the toner image formed on the surface of the intermediate transfer belt 14 is transferred onto the recording sheet S by the secondary transfer roller 16. Residual matter t such as the toners that have not been transferred onto the recording sheet S and remain on the surface of the intermediate transfer belt 14 is removed from the surface of the intermediate transfer belt 14 by a second cleaning device 30.

The recording sheet S having the toner image transferred thereon in the above manner is then guided to a fixing device 19. After the transferred toner image is fixed to the recording sheet S by the fixing device 19, the recording sheet S having the toner image fixed thereto is discharged by discharge rollers 20.

Figure 6A:
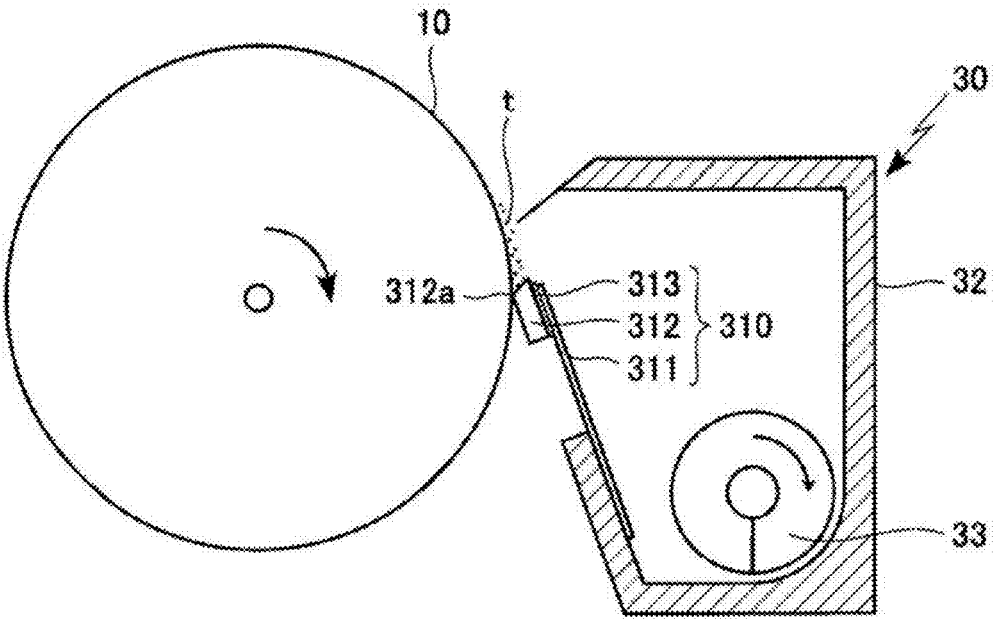
FIGS. 6A and 6B illustrate situations where residual matter remaining on the surface of an image carrier is removed by a cleaning device according to the embodiment.
Figure 6B:
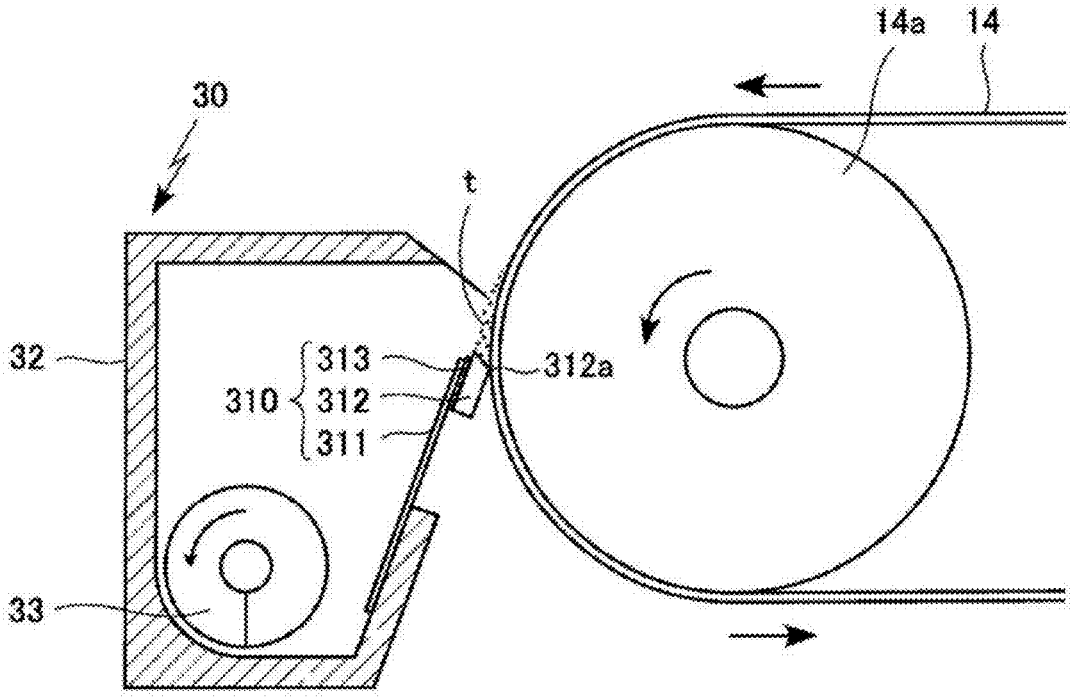

A cleaning member 310 is used in each of the first and second cleaning devices 30 that remove the residual matter t such as the toners that have not been transferred onto the respective photosensitive members 10 and the intermediate transfer belt 14 but remain on the surfaces thereof. As shown in FIGS. 6A and 6B, the cleaning member 310 is formed by bonding a contact member 312 formed with an elastic material to the end of a supporting member 311 with an adhesive 313. The supporting member is formed with a metallic plate spring.

The material of the supporting member 311 may be stainless steel, phosphor bronze, or the like with high corrosion resistance. Particularly, stainless steel, which is strong and hardly fatigues, is preferable. The thickness of the supporting member 311 is preferably 0.03 to 0.1 mm so that the supporting member 311 can follow the corresponding photosensitive member 10 or the intermediate transfer belt 14 in a preferable manner. The material of the contact member 312 may be urethane rubber that is used in conventional cleaning blades. Unlike conventional cleaning blades, the contact member 312 does not need to have a supporting function and a function to provide a contact force. Therefore, it is possible to use fluoro-rubber (FKM), styrene-butadiene rubber (SBR), acrylonitrile rubber (NBR), or the like, and it is more preferable to use a material with excellent abrasion resistance and ozone resistance.

In this cleaning device 30, the end of the contact member 312 bonded to the end of the supporting member 311 of the cleaning member 310 moves in the opposite direction from the direction in which the corresponding photosensitive member 10 or the intermediate transfer belt 14 moves, so that the edge portion 312*a* at the end of the this contact member 312 is brought into contact with the surface of the corresponding photosensitive member 10 or the intermediate transfer belt 14, and the residual matter t such as toner remaining on the surface of the corresponding photosensitive member 10 or the intermediate transfer belt 14 is removed from the surface of the corresponding photosensitive member 10 or the intermediate transfer belt 14 and is collected in a housing 32 by the cleaning member 310. The collected residual matter t such as toner is then moved by a screw 33 installed in the housing 32, and is discharged from the cleaning device 30.

Figure 7A:
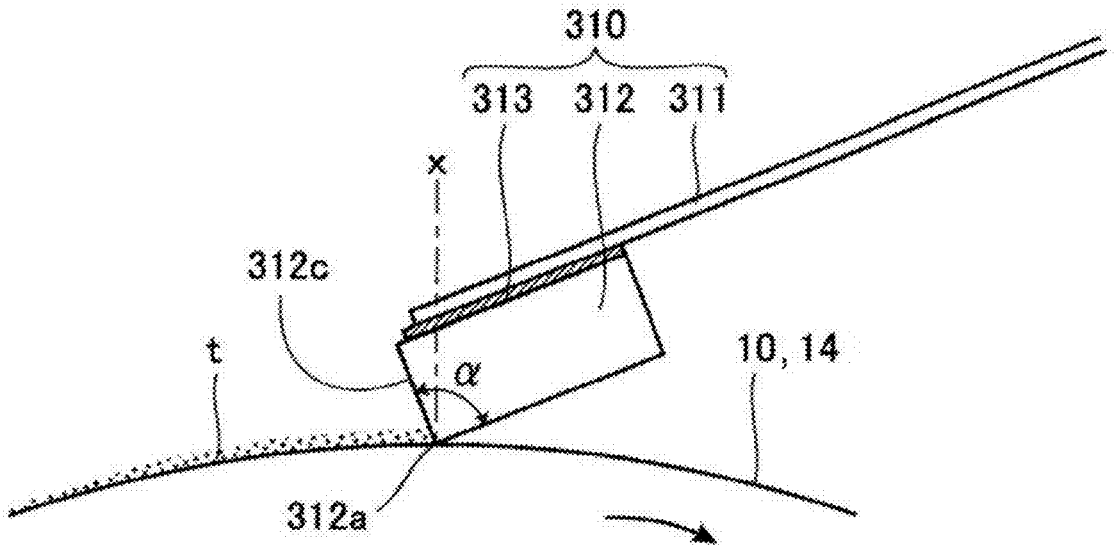
FIGS. 7A and 7B illustrate situations where residual matter remaining on the surface of an image carrier is removed by bringing the edge portion of a contact member made of an elastic material into contact with the surface of the image carrier in a cleaning device according to the embodiment, the contact member being bonded to the end of a supporting member with an adhesive so that the contact member protrudes from the end of the supporting member formed with a metallic plate spring.

In the cleaning device 30 according to this embodiment, the contact member 312 of the cleaning member 310 is bonded to the end of the supporting member 311 of the cleaning member 310 with the adhesive 313 so that the end of the contact member 312 protrudes from the end of the supporting member 311, as shown in FIG. 7A. Further, the angle $\alpha$ of the edge portion 312*a* at the end of the contact member 312 to be brought into contact with the surface of the corresponding photosensitive member 10 or the intermediate transfer belt 14 is set at 90 degrees, and the end of the supporting member 311 is located on the upstream side of the normal line x of the corresponding photosensitive member 10 or the intermediate transfer belt 14 at the contact position of the edge portion 312*a* in the moving direction of the corresponding photosensitive member 10 or the intermediate transfer belt 14.

Figure 7B:
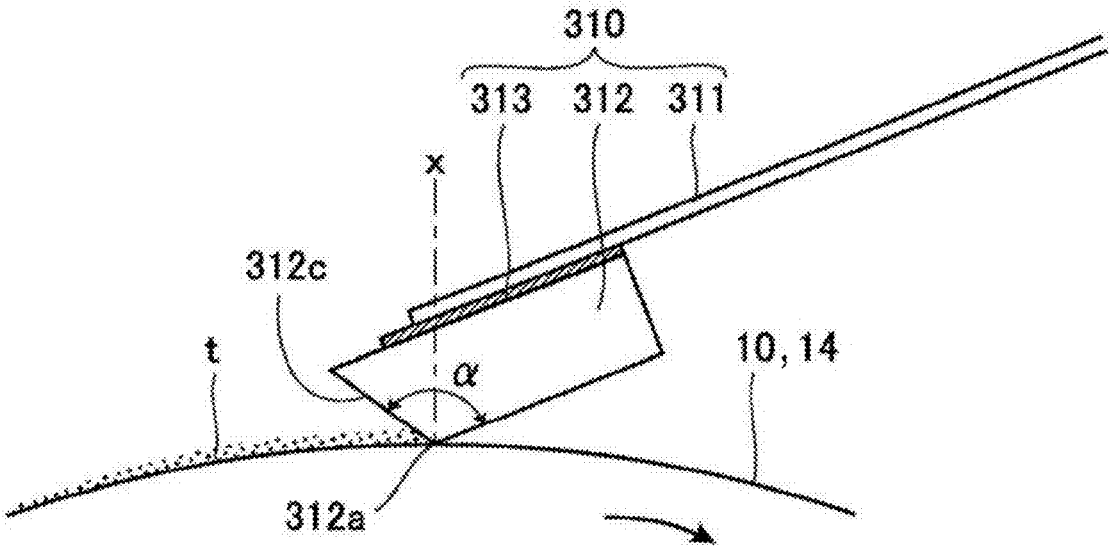

In FIG. 7B, the contact member 312 of the cleaning member 310 is also bonded to the end of the supporting member 311 of the cleaning member 310 with the adhesive 313 so that the end of the contact member 312 protrudes from the end of the supporting member 311. However, the angle $\alpha$ of the edge portion 312*a* at the end of the contact member 312 to be brought into contact with the surface of the corresponding photosensitive member 10 or the intermediate transfer belt 14 is set at an obtuse angle greater than 90 degrees, and the end of the supporting member 311 is located on the upstream side of the normal line x of the corresponding photosensitive member 10 or the intermediate transfer belt 14 at the contact position of the edge portion 312*a* in the moving direction of the corresponding photosensitive member 10 or the intermediate transfer belt 14.

As the contact member 312 is bonded to the end of the supporting member 311 with the adhesive 313 so that the end of the contact member 312 protrudes from the end of the supporting member 311 as shown in FIGS. 7A and 7B, the adhesive 313 is prevented from straying onto the end surface 312*c* of the end of the contact member 312 as described above. In a case where the edge portion 312*a* at the end of the contact member 312 is in contact with the surface of the corresponding photosensitive member 10 or the intermediate transfer belt 14, if the end of the supporting member 311 is located on the upstream side of the normal line x of the corresponding photosensitive member 10 or the intermediate transfer belt 14 at the contact position of the edge portion 312*a* in the moving direction of the corresponding photosensitive member 10 or the intermediate transfer belt 14, the edge portion 312*a* of the contact member 312 is appropriately pressed against the surface of the corresponding photosensitive member 10 or the intermediate transfer belt 14 by the supporting member 311.

Figure 8A:
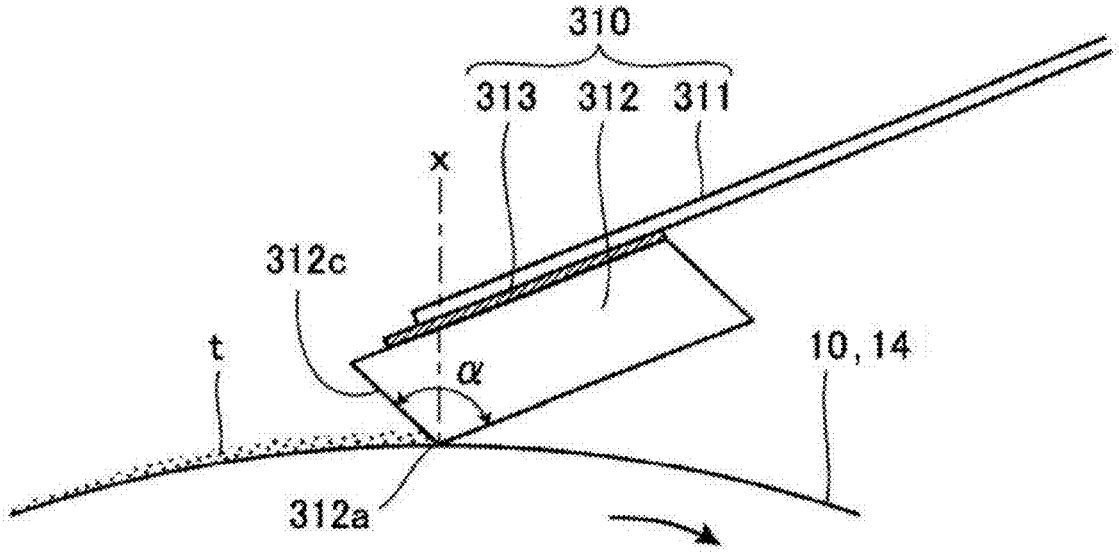
FIGS. 8A and 8B show modifications where the contact member to be bonded to the end of the supporting member is modified in a cleaning device according to the embodiment.
Figure 8B:
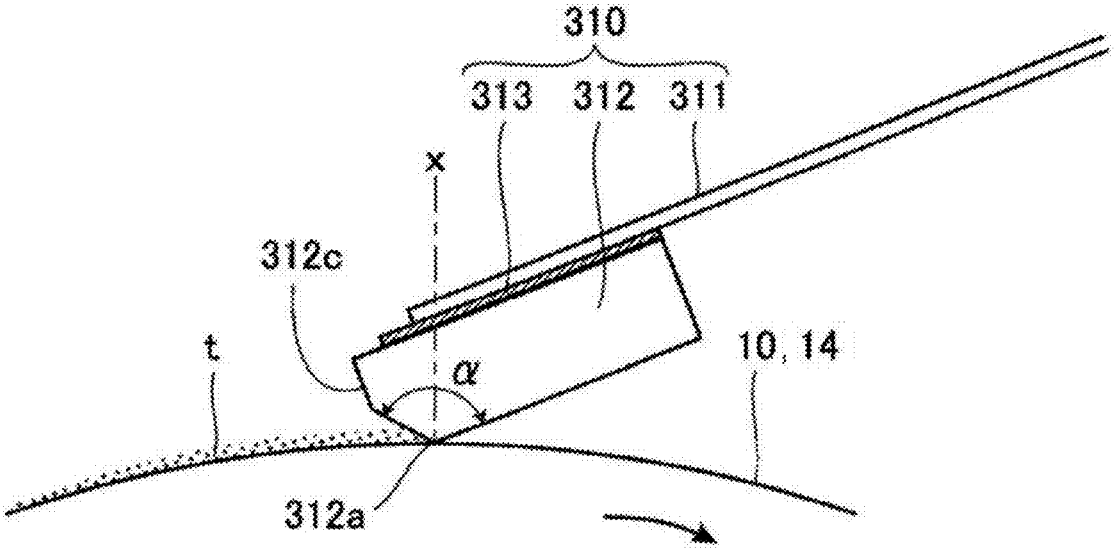
Figure 9:
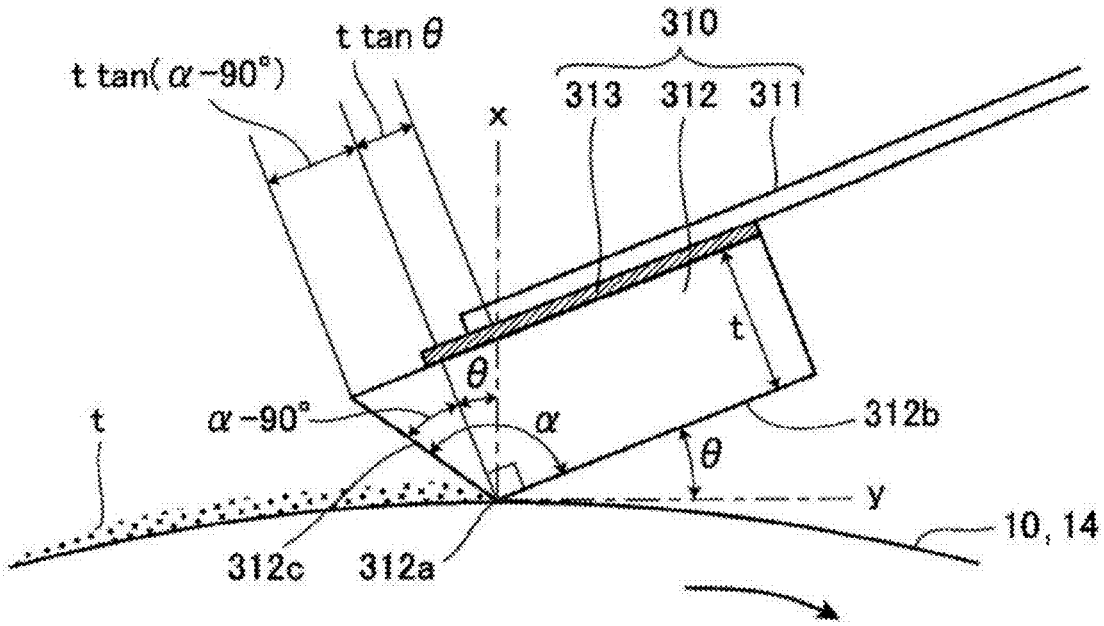
FIG. 9 is a partially enlarged diagram for explaining the conditions in which the edge portion of a contact member bonded to the end of a supporting member with an adhesive is brought into contact with the surface of an image carrier in a cleaning device according to the embodiment, the contact member made of an elastic material protruding from the end of the supporting member formed with a metallic plate spring.

In the embodiment illustrated in FIG. 7B, the contact member 312 has trapezoidal side surfaces each having an obtuse angle as the angle $\alpha$ of the edge portion 312*a*. However, the contact member 312 is not necessarily a member having trapezoidal side surfaces, and may have any appropriate shape, as long as the end of the supporting member 311 is located on the upstream side of the normal line x of the corresponding photosensitive member 10 or the intermediate transfer belt 14 at the contact position of the edge portion 312*a* in the moving direction of the corresponding photosensitive member 10 or the intermediate transfer belt 14 in a case where the edge portion 312*a* at the end of the contact member 312 is in contact with the surface of the corresponding photosensitive member 10 or the intermediate transfer belt 14. For example, the contact member 312 may have parallelogram side surfaces each having an obtuse angle as the angle $\alpha$ of the edge portion 312*a*, as shown in FIG. 8A. Furthermore, the contact member 312 may have pentagonal side surfaces each having an obtuse angle as the angle $\alpha$ of the edge portion 312*a*, as shown in FIG. 8B.

As described above, the contact member 312 is bonded to the end of the supporting member 311 with the adhesive 313 so that the end of the contact member 312 protrudes from the end of the supporting member 311. Further, the angle $\alpha$ of the edge portion 312*a* at the end of the contact member 312 is set at an obtuse angle greater than 90 degrees, and the end of the supporting member 311 is located on the upstream side of the normal line x of the corresponding photosensitive member 10 or the intermediate transfer belt 14 at the contact position of the edge portion 312*a* in the moving direction of the corresponding photosensitive member 10 or the intermediate transfer belt 14. In this case, the condition expressed as $[\tan\theta+\tan(\alpha-90°)]\times t\geq 0.4$ is preferably satisfied, where $\theta$ (°) represents the contact angle between the tangent line y of the corresponding photosensitive member 10 or the intermediate transfer belt 14 at the contact position of the edge portion 312*a* of the contact member 312 and the opposed surface 312*b* on the downstream side of the contact member 312 in the direction from the edge portion 312*a* toward the downstream side in the moving direction of the corresponding photosensitive member 10 or the intermediate transfer belt 14, and t (mm) represents the thickness of the contact member 312. Furthermore, the protruding portion of the end of the contact member 312 protruding from the end of the supporting member 311 preferably has a length of 0.4 mm or greater.

Where the end of the supporting member 311 is located on the upstream side of the normal line x of the corresponding photosensitive member 10 or the intermediate transfer belt 14 in the moving direction of the corresponding photosensitive member 10 or the intermediate transfer belt 14 in the above configuration, the adhesive 313 can be more efficiently prevented from straying onto the end surface 312*c* at the end of the contact member 312 when the contact member 312 is bonded to the end of the supporting member 311 with the adhesive 313 so that the end of the contact member 312 protrudes from the end of the supporting member 311.

Cleaning devices for removing residual matter remaining on the surface of a photosensitive member were modified in various manner with a commercially available multifunctional machine (bizhub C284e, manufactured by KONICA MINOLTA, INC.), and experiments were conducted with different cleaning members in the respective cleaning devices. Evaluations were then made on permanent distortions of the cleaning members, inadequate cleaning, and density unevenness in formed images.

In Example 1 and Comparative Examples 1 and 2, the cleaning member was formed by bonding a contact member that was made of urethane rubber, and was 2 mm in thickness, 8 mm in length, and 340 mm in width, to a supporting member that was made of SUS304, and was 80 μm in thickness, 10 mm in free length, and 340 mm in width. In Comparative Example 3, the cleaning member was a cleaning blade that was made of urethane rubber, and was 2 mm in thickness, 10 mm in free length, and 340 mm in width. The angles of the edge portions of the contact members of Example 1 and Comparative Examples 1 and 2, and the angle of the edge portion of the cleaning blade of Comparative Example 3, which were to be brought into contact with the surfaces of photosensitive members, were 90 degrees.

Figure 1A:
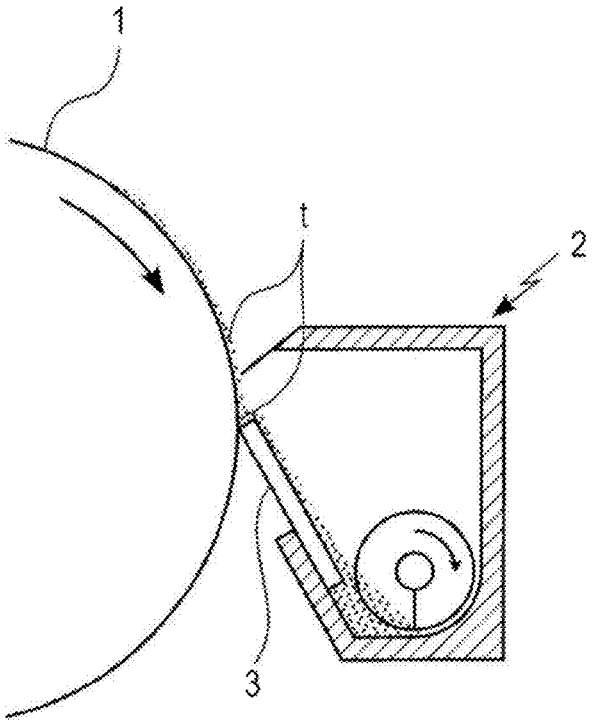
FIGS. 1A and 1B illustrate a situation where residual matter such as toner remaining on the surface of an image carrier is removed by a cleaning member formed with a plate-like cleaning blade made of an elastic material in a conventional cleaning device.
Figure 1B:
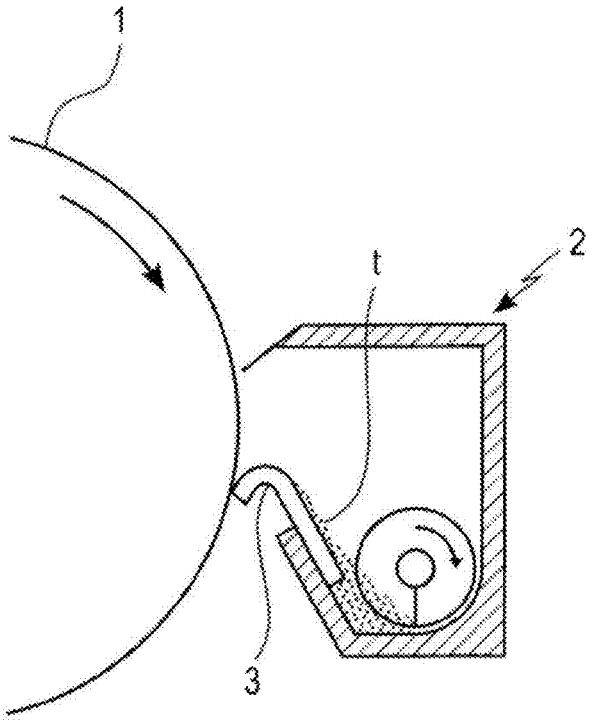
Figure 2:
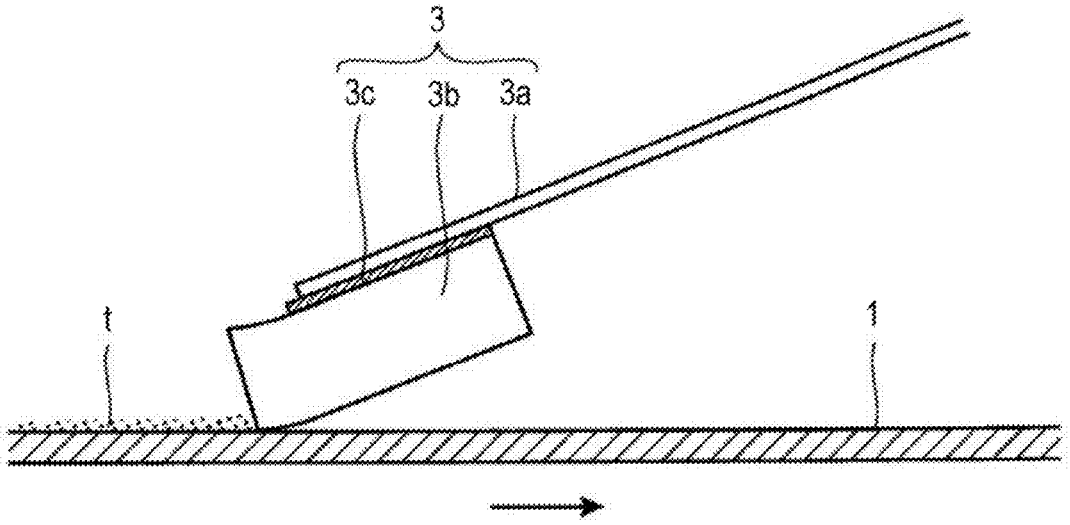
FIG. 2 is a side cross-sectional diagram for explaining a situation where a cleaning member formed by bonding a contact member made of an elastic material to the end of a supporting member with an adhesive so that the contact member protrudes from the end of the supporting member formed with a metallic plate spring is used in removing residual matter such as toner remaining on the surface of an image carrier in a conventional cleaning device.
Figure 3A:
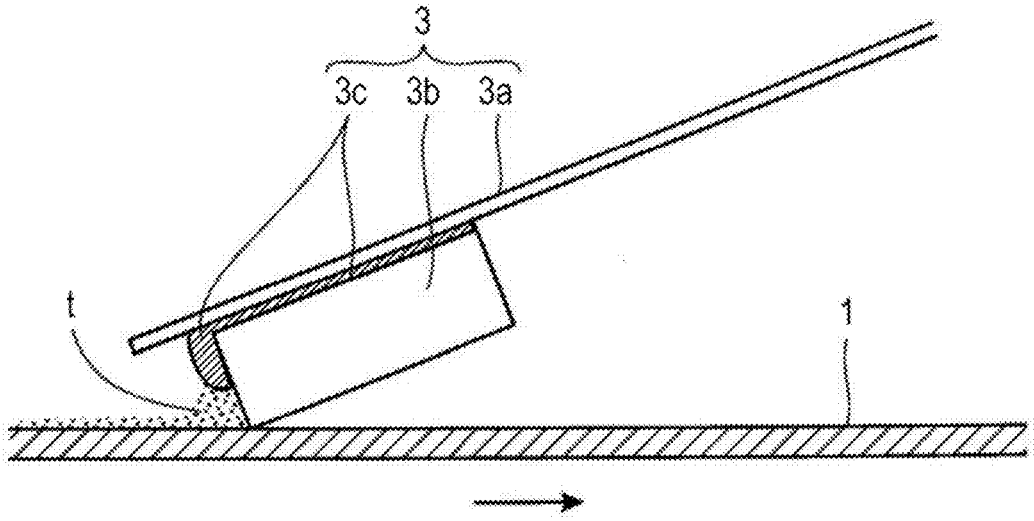
FIGS. 3A and 3B illustrate a situation where a cleaning member formed by bonding a contact member made of an elastic material to the end of a supporting member with an adhesive so that the end of the supporting member formed with a metallic plate spring protrudes from the contact member is used in removing residual matter such as toner remaining on the surface of an image carrier in a conventional cleaning device.
Figure 3B:
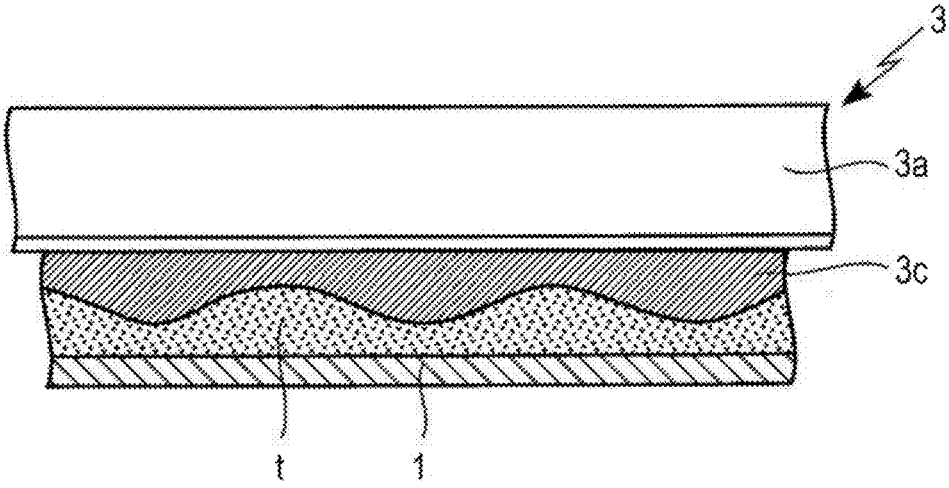
Figure 4A:
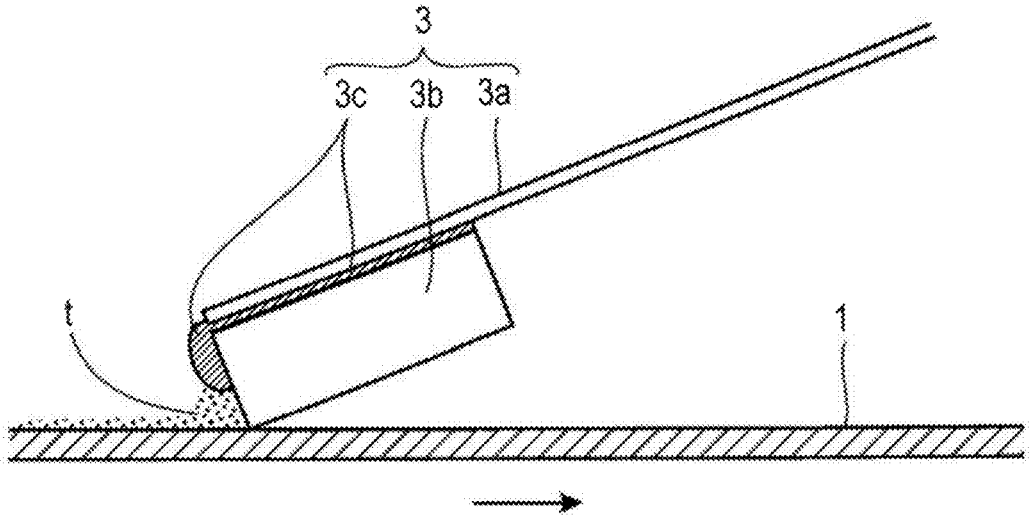
FIGS. 4A and 4B illustrate a case where a cleaning member formed by bonding a contact member made of an elastic member to a supporting member with an adhesive so that the end of the supporting member formed with a metallic plate spring is located in the same position as the end of the contact member is used in removing residual matter such as toner remaining on the surface of an image carrier in a conventional cleaning device.
Figure 4B:
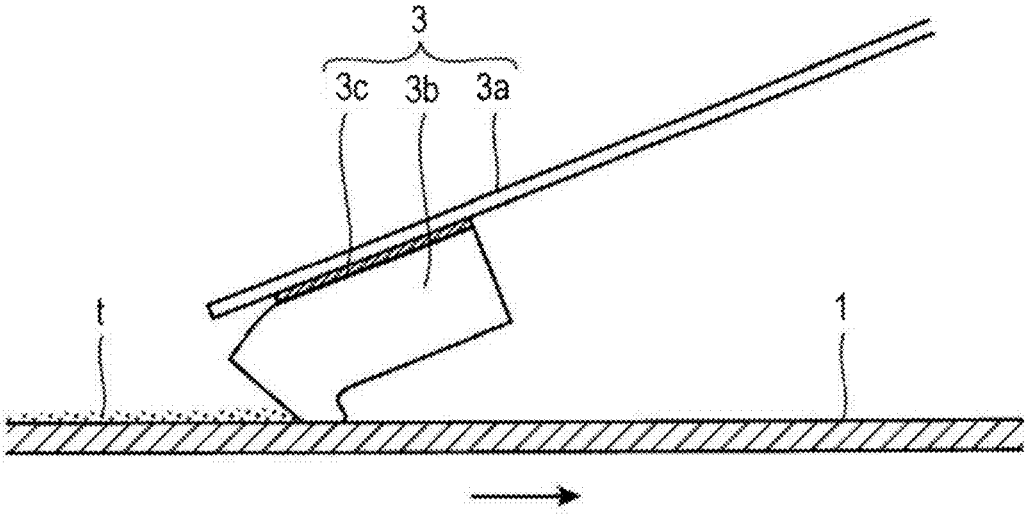

Among the cleaning members of Example 1 and Comparative Examples 1 and 2, when the contact member was bonded to the supporting member with an adhesive, and the edge portion of the contact member was brought into contact with the surface of a photosensitive member as described above, the end of the contact member was made to protrude from the end of the supporting member by 0.5 mm, and the end of the supporting member was located on the upstream side of the normal line of the photosensitive member at the contact position of the edge portion of the contact member in the moving direction of the photosensitive member in Example 1. In Comparative Example 1, on the other hand, the end of the contact member was made to protrude from the end of the supporting member by 1.0 mm, and the end of the supporting member was located on the downstream side, not on the upstream side, of the normal line of the photosensitive member at the contact position of the edge portion of the contact member in the moving direction of the photosensitive member. In Comparative Example 2, the end of the supporting member and the end of the contact member were located in the same position, and the end of the supporting member was located on the upstream side of the normal line of the photosensitive member at the contact position of the edge portion of the contact member in the moving direction of the photosensitive member. In the cleaning member of Comparative Example 2, the adhesive strayed onto the end surface of the end of the contact member, as shown in FIG. 4A.

Figure 10:
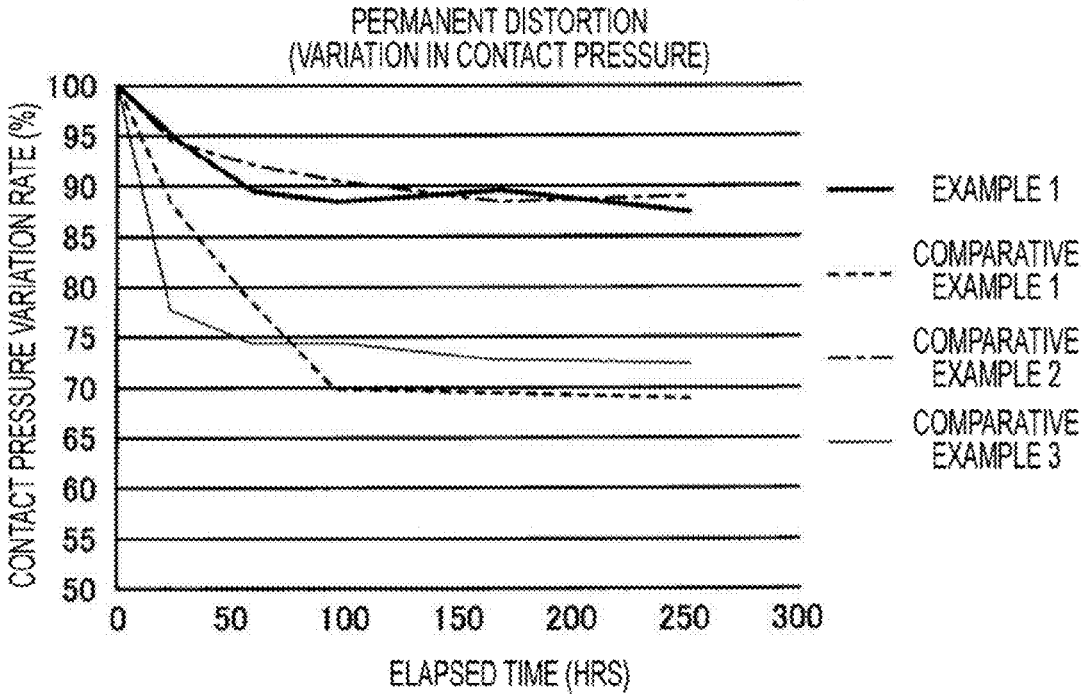
FIG. 10 is a graph showing changes in contact pressure over time in a case where the edge portions of the contact members brought into contact with the surfaces of photosensitive members were left for a certain period of time, and permanent distortions of the cleaning members were evaluated in cleaning devices of Example 1 and Comparative Examples 1 through 3.

Among the cleaning devices of Example 1 and Comparative Examples 1 through 3 using the above cleaning members, permanent distortions of the cleaning members were evaluated in a high-temperature, high-humidity environment where the temperature was 40 degrees centigrade, and the humidity was 95%. The contact pressure at which the edge portion is brought into contact with the surface of the photosensitive member was 30 N/m, and the contact angle θ was set at 15 degrees. The samples were left in such conditions for about 250 hours. The changes in the contact pressure were examined, and the results are shown in FIG. 10. The results are also shown below in Table 1 in which a contact pressure decrease smaller than 15% after a sample was left for about 250 hours was evaluated as "good", and a contact pressure decrease equal to or greater than 15% was evaluated as "poor".

Furthermore, among the cleaning devices of Example 1 and Comparative Examples 1 through 3, inadequate cleaning and density unevenness were evaluated in an environment where the temperature was 23 degrees centigrade, and the humidity was 55%. The contact pressure at which the edge portion was brought into contact with the surface of the photosensitive member was set at 23 N/m, and the contact angle θ was set at 15 degrees. Images with a coverage of 5% were printed once in three sheets and on a total of 50,000 sheets. As for inadequate cleaning, a case where an excellent image without any inadequate cleaning was obtained was evaluated as "good", and a case where inadequate cleaning affected the image was evaluated as "poor". As for density unevenness, a case where an excellent image without any density unevenness was obtained was evaluated as "good", and a case where density unevenness was observed in the image was evaluated as "poor". These evaluations are shown below in Table 1.

Comparative Example 1 in which the end of the contact member was made to protrude from the end of the supporting member but the end of the supporting member did not cross the normal line of the photosensitive member at the contact position of the edge portion of the contact member, and in the cleaning device of Comparative Example 3 in which a cleaning blade was used as the cleaning member. Further, inadequate cleaning and density unevenness were observed in the cleaning device of Comparative Example 2 in which the end of the supporting member and the end of the contact member were located in the same position, and the adhesive strayed onto the end surface of the end of the contact member.

In Example 1, a contact member with an edge portion having an angle of 90 degrees was used as described above. However, in a case where a contact member with an edge portion having an obtuse angle greater than 90 degrees is used, the same effects as those of Example 1 can be obtained, and the characteristic configuration can be more readily achieved. That is, the end of the contact member can be more readily made to protrude from the end of the supporting member, and the end of the supporting member can be more readily located on the upstream side of the normal line of the photosensitive member at the contact position of the edge portion of the contact member in the moving direction of the photosensitive member.

According to an embodiment of the present invention, in a cleaning device, a contact member is bonded to the end of a supporting member in such a manner that the end of the contact member protrudes from the end of the supporting member. In this manner, the adhesive is prevented from straying onto the end surface of the end of the contact member as described above. Furthermore, in a case where the edge portion at the end of the contact member is brought into contact with the surface of an image carrier, the end of the supporting member is located on the upstream side of the normal line of the image carrier at the contact position of the edge portion. Thus, the edge portion of the contact member is appropriately pressed against the surface of the image carrier by the supporting member, and the end of the contact member is prevented from being deformed over time.

As a result, where a cleaning device according to an embodiment of the present invention is used, the contact member formed with an elastic material can be brought into contact with the surface of an image carrier stably with a sufficient contact pressure by the supporting member formed with a metallic plate spring. Furthermore, the adhesive does

TABLE 1

| | Type of cleaning member | Relationship between end of supporting member and end of contact member | Relationship between end of supporting member and normal line | Stray adhesive on end surface of contact member | Evaluation | | |
|---|---|---|---|---|---|---|---|
| | | | | | Permanent distortion | Inadequate cleaning | Uneven density |
| Example 1 | Supporting member + contact member | Contact member protruding | Normal line crossed | Not observed | Good | Good | Good |
| Comparative example 1 | Supporting member + contact member | Contact member protruding | Normal line not crossed | Not observed | Poor | Good | Good |
| Comparative example 2 | Supporting member + contact member | Matching in position | Normal line crossed | Observed | Good | Poor | Poor |
| Comparative example 3 | Cleaning blade | N/A | N/A | N/A | Poor | Good | Good |

As is apparent from the results, all the evaluations on the permanent distortion, inadequate cleaning, and density unevenness were good in the cleaning device of Example 1 in which the end of the contact member was made to protrude from the end of the supporting member, and the end of the supporting member was located on the upstream side of the normal line of the photosensitive member at the contact position of the edge portion of the contact member in the moving direction of the photosensitive member.

On the other hand, the permanent distortions of the cleaning members were large in the cleaning device of not stray onto the end surface of the end of the contact member, and the amount of residual matter staying on the end surface of the contact member brought into contact with the surface of the image carrier is prevented from varying in the longitudinal direction of the contact member, so that residual matter on the surface of the image carrier can be appropriately removed over a long period of time.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A cleaning device comprising a cleaning member configured to move in the opposite direction from a moving direction of an image carrier and come into contact with a surface of the image carrier to remove residual matter from the surface of the image carrier, wherein the cleaning member includes a supporting member formed with a metallic plate spring and a contact member formed with an elastic material, the contact member being bonded to an end of the supporting member with an adhesive, an edge portion at an end of the contact member being brought into contact with the surface of the image carrier, the end of the contact member protrudes from the end of the supporting member, and the end of the supporting member is located on an upstream side of a normal line of the image carrier at the contact position of the edge portion in the moving direction of the image carrier, wherein the condition expressed as $[\tan\theta+\tan(\alpha-90°)]\times t\geq 0.4$ is satisfied, where $\alpha$ (°) represents an angle of the edge portion of the contact member, $\theta$ (°) represents a contact angle between a tangent line of the image carrier at the contact position of the edge portion of the contact member and an opposed surface on a downstream side of the contact member in a direction from the edge portion toward a downstream side in the moving direction of the image carrier, and t (mm) represents a thickness of the contact member, wherein the contact angle $\theta$ (°) is in the range of 10 to 20 degrees.

2. The cleaning device according to claim 1, wherein an angle of the edge portion of the contact member to be brought into contact with the surface of the image carrier is set at a greater angle than 90 degrees.

3. The cleaning device according to claim 1, wherein a protruding portion of the end of the contact member protruding from the end of the supporting member has a length of 0.4 mm or greater.

4. An image forming apparatus comprising the cleaning device of claim 1 configured to remove residual matter on a surface of an image carrier.

* * * * *